US009848724B1

(12) United States Patent
Korsyn

(10) Patent No.: US 9,848,724 B1
(45) Date of Patent: Dec. 26, 2017

(54) UNIQUE AND FUNCTIONAL MAILBOX SUPPORT

(71) Applicant: Jeffrey Korsyn, West Chester, PA (US)

(72) Inventor: Jeffrey Korsyn, West Chester, PA (US)

( * ) Notice: Subject to any disclaimer, the term of this patent is extended or adjusted under 35 U.S.C. 154(b) by 0 days.

(21) Appl. No.: 15/444,421

(22) Filed: Feb. 28, 2017

Related U.S. Application Data

(60) Provisional application No. 62/304,278, filed on Mar. 6, 2016.

(51) Int. Cl.
*A47G 29/12* (2006.01)

(52) U.S. Cl.
CPC ..... *A47G 29/1216* (2013.01)

(58) Field of Classification Search
CPC ..... A47G 29/1216; E04H 12/223; E02D 5/80
USPC ..... 232/39; D99/32; 248/146, 156; 52/156
See application file for complete search history.

(56) References Cited

U.S. PATENT DOCUMENTS

D199,107 S * 9/1964 Kusel ..... D25/130
3,762,672 A * 10/1973 Tabbert ..... A47G 29/1216 248/146
5,065,975 A * 11/1991 Giles ..... E04H 12/223 232/39
7,172,163 B1 * 2/2007 Johnson ..... A47G 29/1216 232/39
7,275,680 B1 * 10/2007 Pins ..... A47G 29/1216 232/39
D634,094 S * 3/2011 Benavidez ..... D99/30
8,061,089 B2 * 11/2011 Russell ..... A47G 29/1216 52/156
D679,475 S * 4/2013 Frye ..... D99/32
D690,075 S * 9/2013 Belo ..... D99/32
2007/0138249 A1 * 6/2007 Webber ..... A47G 29/1216 232/39
2010/0000164 A1 * 1/2010 Russell ..... E04H 12/2215 52/165
2011/0253877 A1 * 10/2011 McCown ..... A47G 29/1216 248/548

* cited by examiner

*Primary Examiner* — William Miller
(74) *Attorney, Agent, or Firm* — Michael J. Feigin, Esq.; Feigin and Fridman

(57) ABSTRACT

A mailbox with silhouette support is disclosed. The silhouette has a flat front and back side which is staked into the ground at two-spaced apart places. The spaced apart places are, in some embodiments, further split by a portal there-between forming a "leg" on either side of the silhouette. The legs connect at a body region, in some embodiments, with a head region there-above. The head region supports and is directly connected to a mailbox which is situated above the silhouette, at least in part.

13 Claims, 9 Drawing Sheets

UNIQUE AND FUNCTIONAL MAILBOX SUPPORT

FIELD OF THE DISCLOSED TECHNOLOGY

The disclosed technology relates to a unique and functional mailbox support that has unlimited opportunity for individuality of expression while having excellent accessibility and ease of use.

BACKGROUND OF THE DISCLOSED TECHNOLOGY

Many people have curbside mailboxes. Curbside mailboxes are one of the few ways to get mail delivered to a home or business. In some areas of the United States, the US Post office has a policy of not bringing the mail directly to the recipient's dwelling. Therefore a curbside mailbox is the only way to receive mail in those areas. A new mail box support which provides a way to express one's self and one's interests would be very useful. In addition, this mailbox support has optimal accessibility, ease of use, long-term durability, and ease of manufacture. The disclosed mailbox support system is in compliance with all US Postal Service rules, such as height above the ground and distance to road. This mailbox support system also offers unlimited opportunity for self-expression with curb appeal for a home or business.

SUMMARY OF THE DISCLOSED TECHNOLOGY

The disclosed technology described herein addresses an unfulfilled need in the prior art by providing a silhouette shape of choice as part of a mailbox support system that is durable and is easy to use and manufacture.

The disclosed technology combines simplicity of construction with unlimited design or silhouette shape options. Regardless of the design, the silhouette shape has a lateral dimension that is as much as 250 times its depth dimension, creating a dramatically unique support system.

The disclosed mailbox support system can also aid visitors in confirming that they have reached the correct destination. Businesses have the option to use a shape that makes their business easily identifiable. For example, an auto mechanic could choose a wrench, while a dentist could choose to use a toothbrush, and so on.

In one objective of the disclosed invention, a device for mailbox support system comprises a solid silhouette shaped profile and a plurality of stakes attached to the bottom side of said silhouette shaped profile. A bracket is attached on the upper most part of the silhouette shaped profile and a mailbox mounted to said bracket. The solid silhouette shaped profile has a lateral dimension that is up to 250 times its depth dimensions.

In embodiments of the disclosed technology, a mailbox support system has a silhouette of a figure, such as a human figure having a thickness less than or equal to 1/224th of its height and a first leg region and a second leg region. A "human figure" is defined as a shape recognizable by an ordinary observer as being that of a human profile, side view, shadow, or silhouette. A "figure" is defined similar to the definition for "human figure" except that the "figure" is any recognizable object, such as one in real-size to the silhouette. The height thereof is the distance perpendicular to the ground on which the silhouette is there-above to a bottom of the mailbox. Thickness refers to a direction of the silhouette which is most narrow and is generally parallel to the ground on which the silhouette stands there-above. The "leg regions" are those which are representative of legs and/or those which are split into two regions between the ground and a body or torso region. The body or torso region is a region of the silhouette which is unbroken and solid between leg regions beneath and a neck or head region above. The neck region is a region which is narrower than the body region and head region and situated there-between the neck/head and leg region. The head region is a top most region which is connected, on a top side thereof, to a mailbox. A mailbox is defined as a mostly, fully, or closed box with sides defining an inner region designed to receive mail.

Each first leg region and said second leg region is attached to a stake; the stake is configured to extend below ground, in embodiments of the disclosed technology. A stake is an elongated and rigid device to which the silhouette is attached; the stake has a pointed end designed for being driven into a malleable surface such as the ground. A mailbox having a lower side centered over the silhouette (centered along at least one axis, such as the y-axis) and at least partially situated over a space between the first leg region and the second leg region is used in embodiments of the disclosed technology.

The mailbox, and by extension, each of the items described herein, have various sides. A front side of the device, and especially the mailbox, is a side thereof which is meant to face towards a street or which has a door which opens and closes to receive or remove mail. In embodiments of the disclosed technology, the mailbox itself is the front-most portion of the device as a whole (the mailbox being closer to a street than the support structure underneath the mailbox). Likewise, the silhouette has a front side which is on this same side relative to the mailbox, and is, in embodiments, the direction in which the silhouette is facing. A first leg region extends less far in a frontal direction than the mailbox, in some embodiments. In others, a second leg region extends further in a rear direction than the mailbox.

A portal in a top side of the silhouette separates two spaced-apart regions which connect to the mailbox. In other embodiments, the top side of the silhouette is rounded and connects to the bottom side of the mailbox. "Top" and "bottom" are terms relative to the ground and describe the manner in which the elements of the disclosed technology are generally arranged, with the mailbox at the "top" (furthest away from the ground) and stakes at the "bottom" (closest to, or passing through the ground).

A center of gravity of the combination of the mailbox and silhouette is between the first leg region and the second leg region in the space created between the legs, in some embodiments.

Another way of describing the present technology, is as a mailbox with a flat bottom side which extends between a front side and back side thereof, the front side having a hinged door. A silhouette base (devices supporting the mailbox) is less than 1/3th of the width of the mailbox and situated under the mailbox in embodiments of the disclosed technology. A connection mechanism (glue, nail, screw, bracket, combination thereof) connects the mailbox into a top side of the silhouette. Either the front side of the silhouette or the back side of the silhouette, or both, extend further to a respective front or back side than the mailbox in some embodiments. At least two stakes attached to a bottom side of the silhouette attach the silhouette to or through the ground. There is a spaced apart region between the two or more stakes where the silhouette splits into two parts, and each part of the two parts separately attaches the silhouette to the ground in some embodiments.

The silhouette has various regions in some embodiments, including, from top to a bottom, some or all of a head region, a neck region, a body region, and leg regions. An arm region or arm regions extend from and connect only to the body region in some embodiments. Such arm regions are defined by having a narrow contiguous portion with the body region and open space between the arm region or arm regions and the mailbox. The arm regions can also extend further to the back or front of the mailbox, while the body region is entirely or mostly under the mailbox.

In accordance with these and other objectives, which will become apparent hereinafter, the disclosed technology will now be described with particular reference to the drawings.

Any described element or item can be "substantially" or "fully" as described. Substantially refers to more than 95% so, and fully is within a statistical margin of error of 100% as described. The term "and/or" includes either element and both elements joined by the term.

Figure 1:
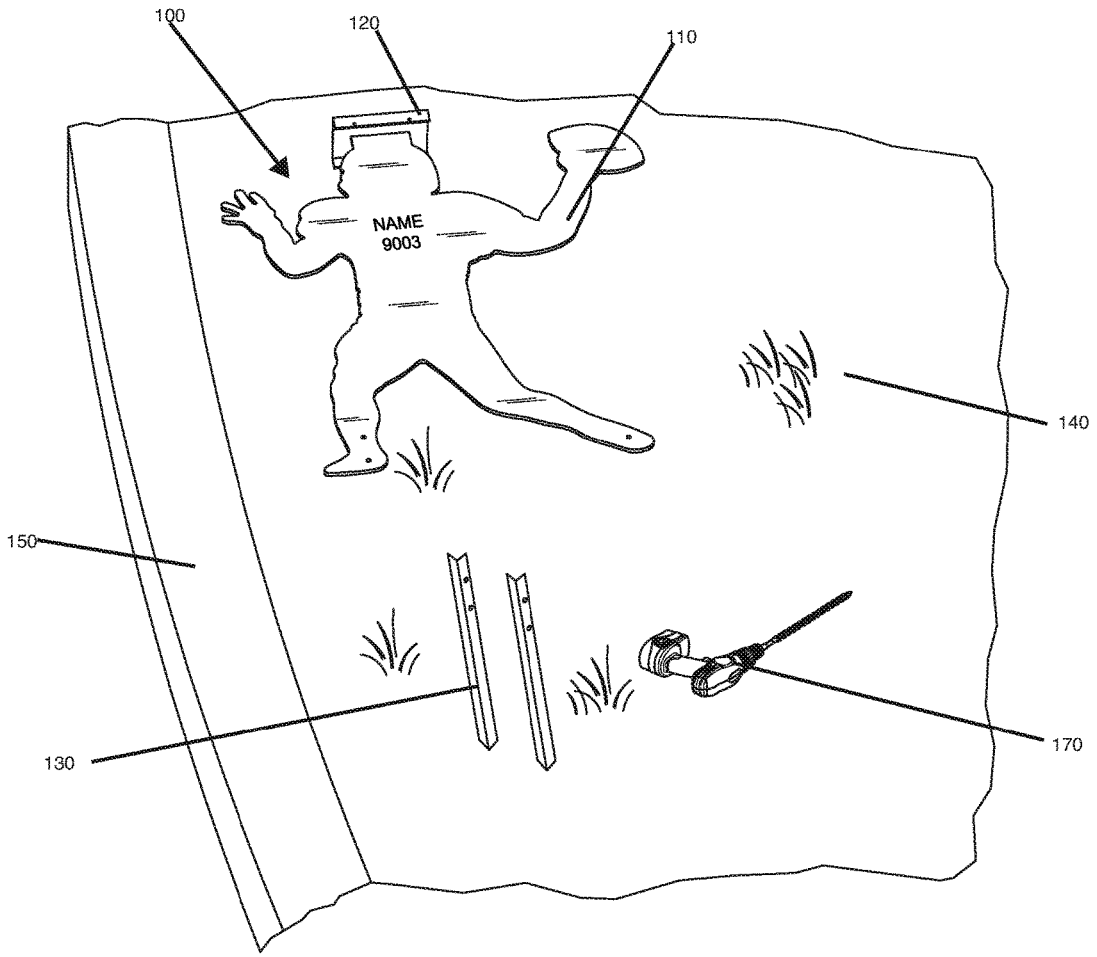
FIG. 1 shows a perspective view of the mailbox support system of the disclosed technology prior to placement in the ground.

A better understanding of the disclosed technology will be obtained from the following detailed description of the preferred embodiments, taken in conjunction with the drawings and the attached claims.

DETAILED DESCRIPTION OF EMBODIMENTS OF THE DISCLOSED TECHNOLOGY

A mailbox with silhouette support is disclosed. The silhouette has a flat front and a back side which are staked into the ground at two-spaced apart places. The spaced apart places are, in some embodiments, further split by a portal there-between forming a "leg" on either side of the silhouette. The legs connect at a body region, in some embodiments, with a head region there-above. The head region supports and is directly connected (including via a bracket or connector) to a mailbox which is situated above the silhouette, at least in part.

The ensuing detailed description provides preferred exemplary embodiments only, and is not intended to limit the scope, applicability, or configuration of the disclosed technology. Rather, the ensuing detailed description of the preferred exemplary embodiments will provide those skilled in the art with an enabling description for implementing the preferred exemplary embodiments of the technology. Various changes may be made in the function and arrangement of elements without departing from the spirit and scope of the disclosed technology, as set forth in the appended claims.

To aid in describing the disclosed technology, directional terms may be used in the specification and claims to describe portions of the present technology (e.g., upper, lower, left, right, etc.). These directional definitions are merely intended to assist in describing and claiming the disclosed technology and are not intended to limit the disclosed technology in any way. In addition, reference numerals that are introduced in the specification in association with a drawing figure may be repeated in one or more subsequent figures without additional description in the specification, in order to provide context for other features.

With reference now to the drawings, a device is shown for support of a curbside mailbox.

Figure 2:
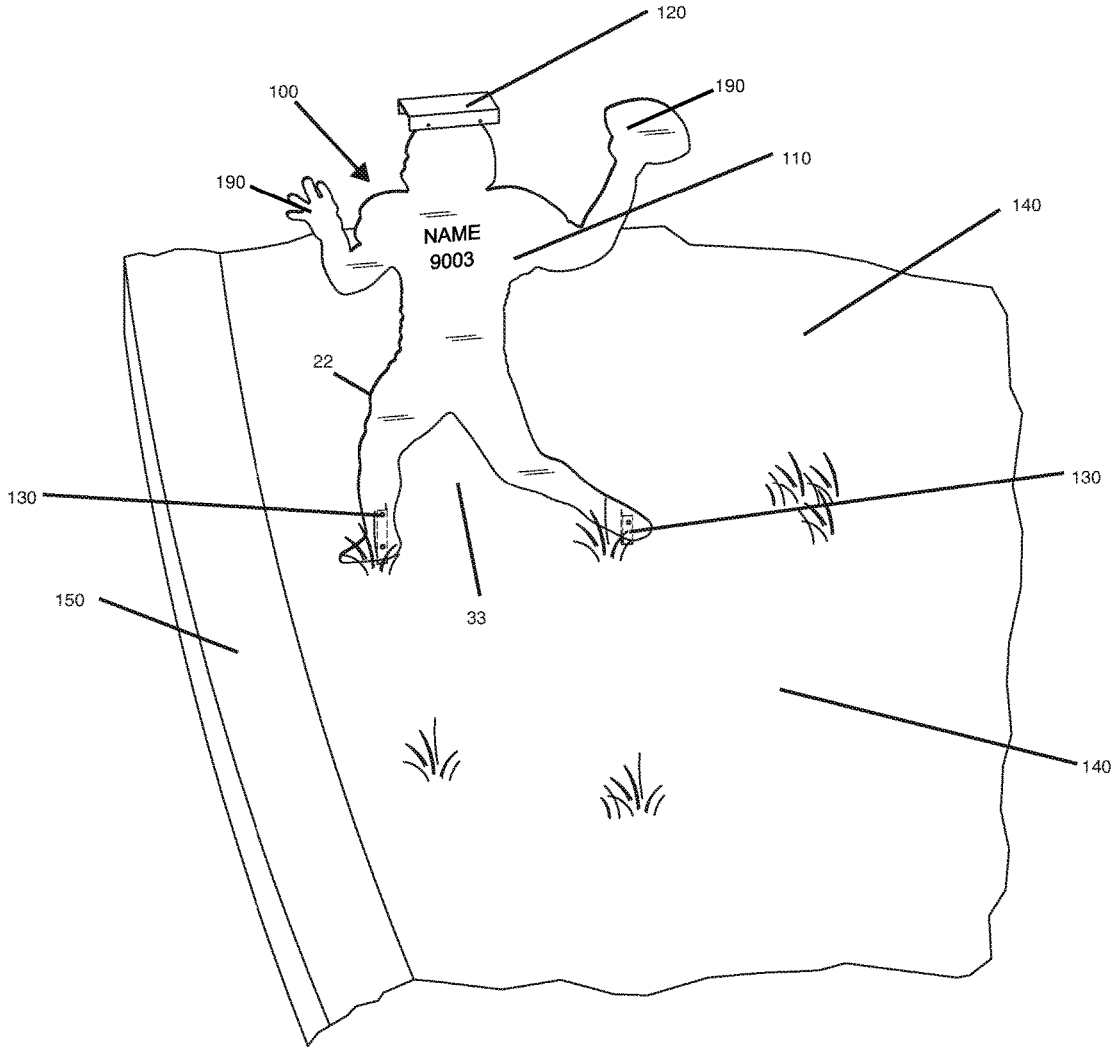
FIG. 2 shows a perspective view of the mailbox support system of the disclosed technology.

Referring to FIGS. 1 and 2, reference number 100 refers generally to mailbox support system for attaching a standard curbside mailbox. The main silhouette shape 110 is a solid profile, which is also decorative. The silhouette shape 110 is any design. One option is to fabricate or cut out the design from a sheet stock of material. Alternatively, the design is molded or cast from a variety of materials, for example plastic, metal or composites. Some examples of design shapes are: an athlete; a dog; a guitar; a wrench or other readily identifiable shapes.

Figure 5:
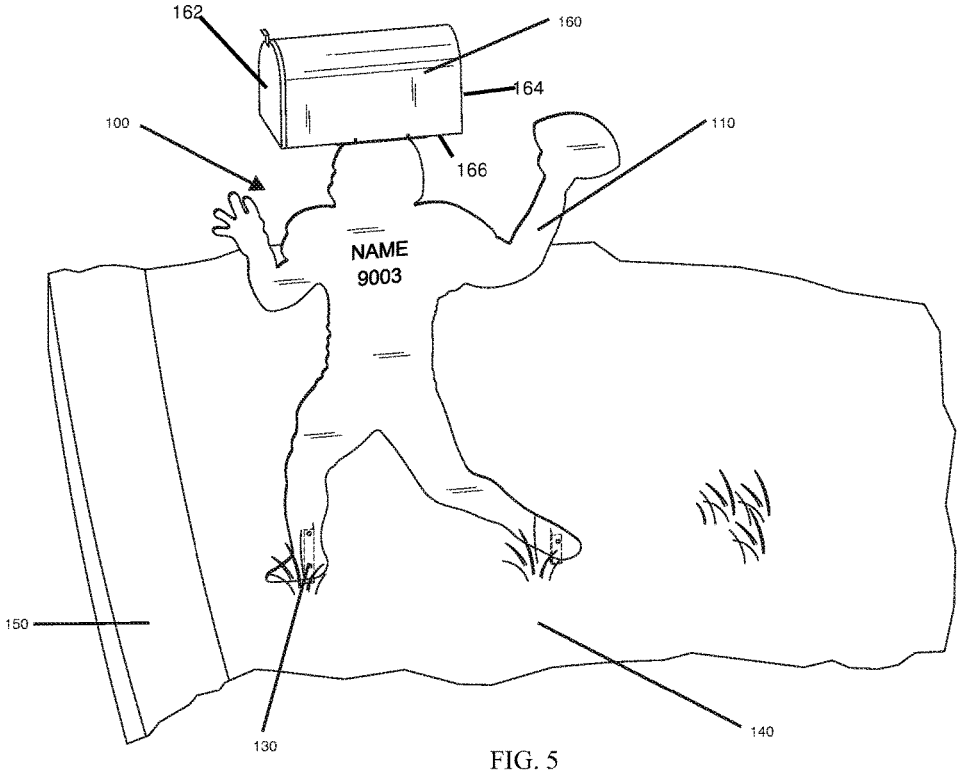
FIG. 5 is a perspective view of one mailbox support silhouette shape with a mailbox attached of the disclosed technology.

A bracket 120 is affixed to the uppermost point of the silhouette 110, to be the support for a mailbox 160, which is affixed as seen in FIG. 5. A plurality of stake type brackets 130 are bolted to the silhouette shape 110 to secure the silhouette shape 110 to the ground 140. A power drill 170 is one method used to start the aperture in the ground 140 to ease the installation of the stake type brackets 130 into the ground 140. The silhouette shape 110 would preferably be placed near a curb 150 (for purposes of this disclosure, defined as an actual curb or where a property meets the road).

The mailbox silhouette shape 110 can extend 41-45 inches from ground level 140, since the US Postal Service requires mailboxes 160 to be mounted at that height. The width or lateral dimension of the silhouette shape 110 would vary by the shape chosen, but is typically half of the height. In one embodiment, the silhouette shape 110 is fabricated out of $3/16$-inch thick steel plate, which is a fraction of the height.

Figure 6:
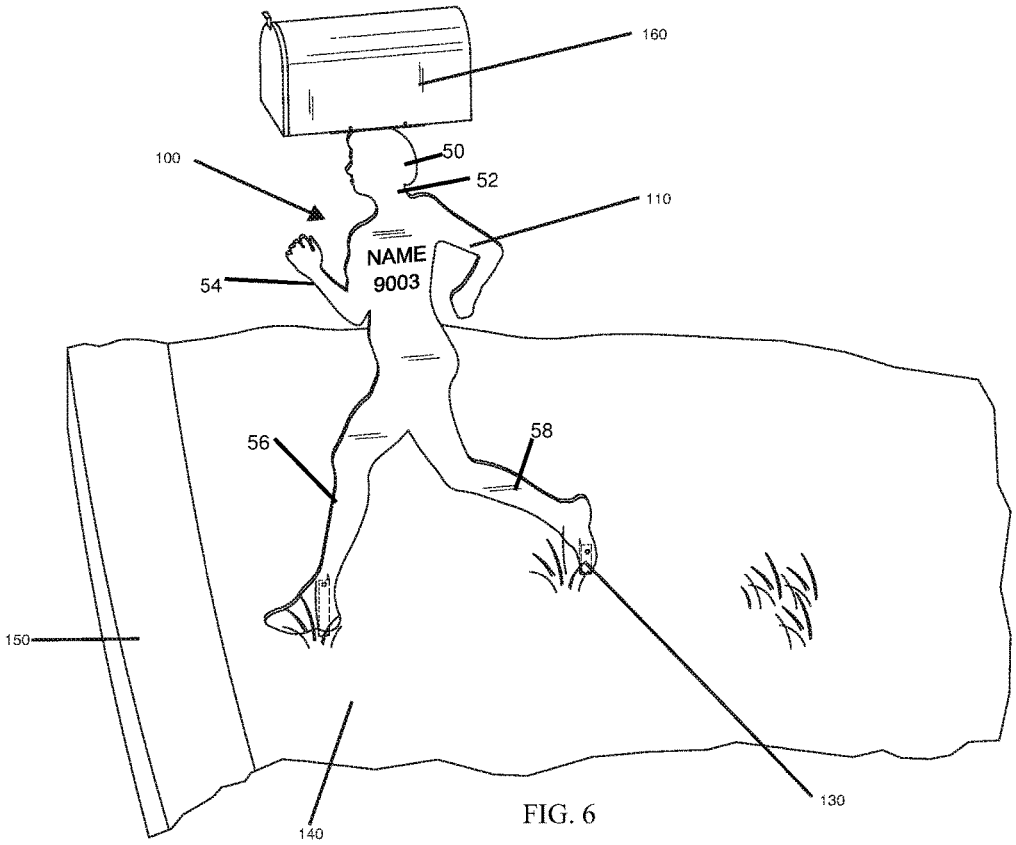
FIG. 6 is a perspective view of another mailbox support silhouette shape with a mailbox attached of the disclosed technology.
Figure 7:
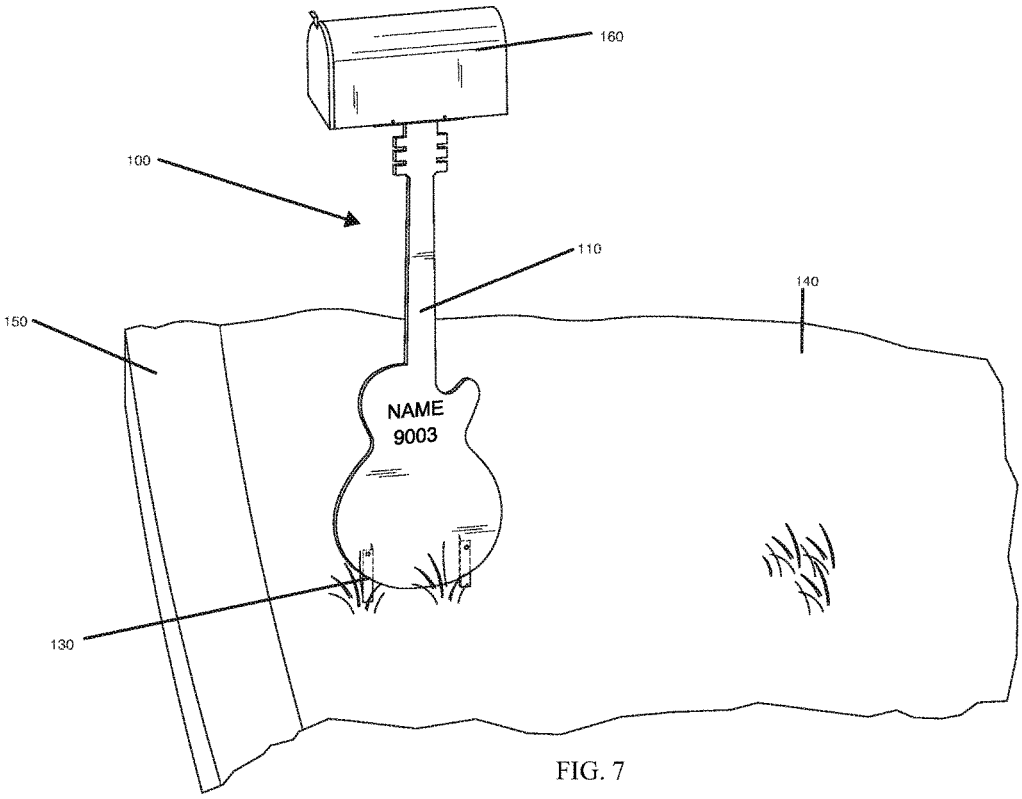
FIG. 7 is a perspective view of a third mailbox support silhouette shape with a mailbox attached of the disclosed technology.

Returning now more specifically to FIG. 2 as well as FIG. 6, one sees that there is a portal 33 between a first leg 56 and second leg 58. The legs have the brackets 130 which are also referred to as "stakes" in this disclosure. The stakes attach the legs to the ground 140. Between the legs is a portal or space 33 which is where the center of gravity resides in some embodiments of the disclosed technology. The silhouette further has a thickness 22 which is less than $1/100$th, $1/224$th or $1/250$th of the height thereof. The $1/224$th amount is derived from the height of a mailbox according to United States postal regulations, and experiments showing that when viewed from the front, at this depth ratio, the sides are substantially or fully invisible to the viewer. The thickness is perpendicular to the height and parallel to the ground when the silhouette is standing. Note also that some versions of the silhouette have two arms 190 or 54. Thus, the legs 56 and 58 are separated from each other and where they join together; this is the body of the silhouette 110. A narrower top portion above the body is the head region 50, designed to appear as a head to an ordinary observer. A neck region 52 separates the head and body regions in some embodiments, being narrower than both the head and body regions.

Figure 3:
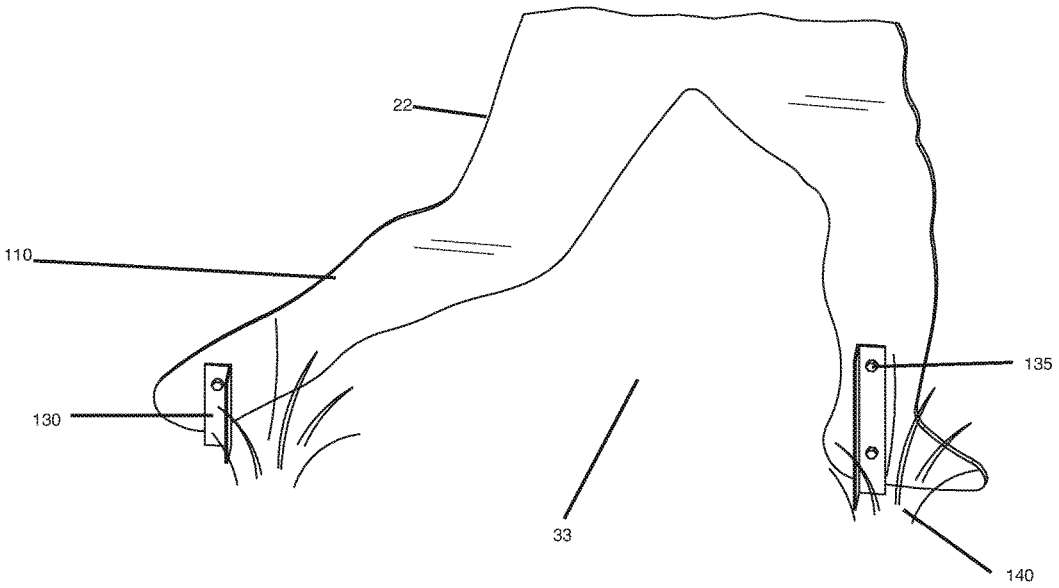
FIG. 3 shows a fragment view of the mailbox support system's stake type brackets after placement in the ground.
Figure 4:
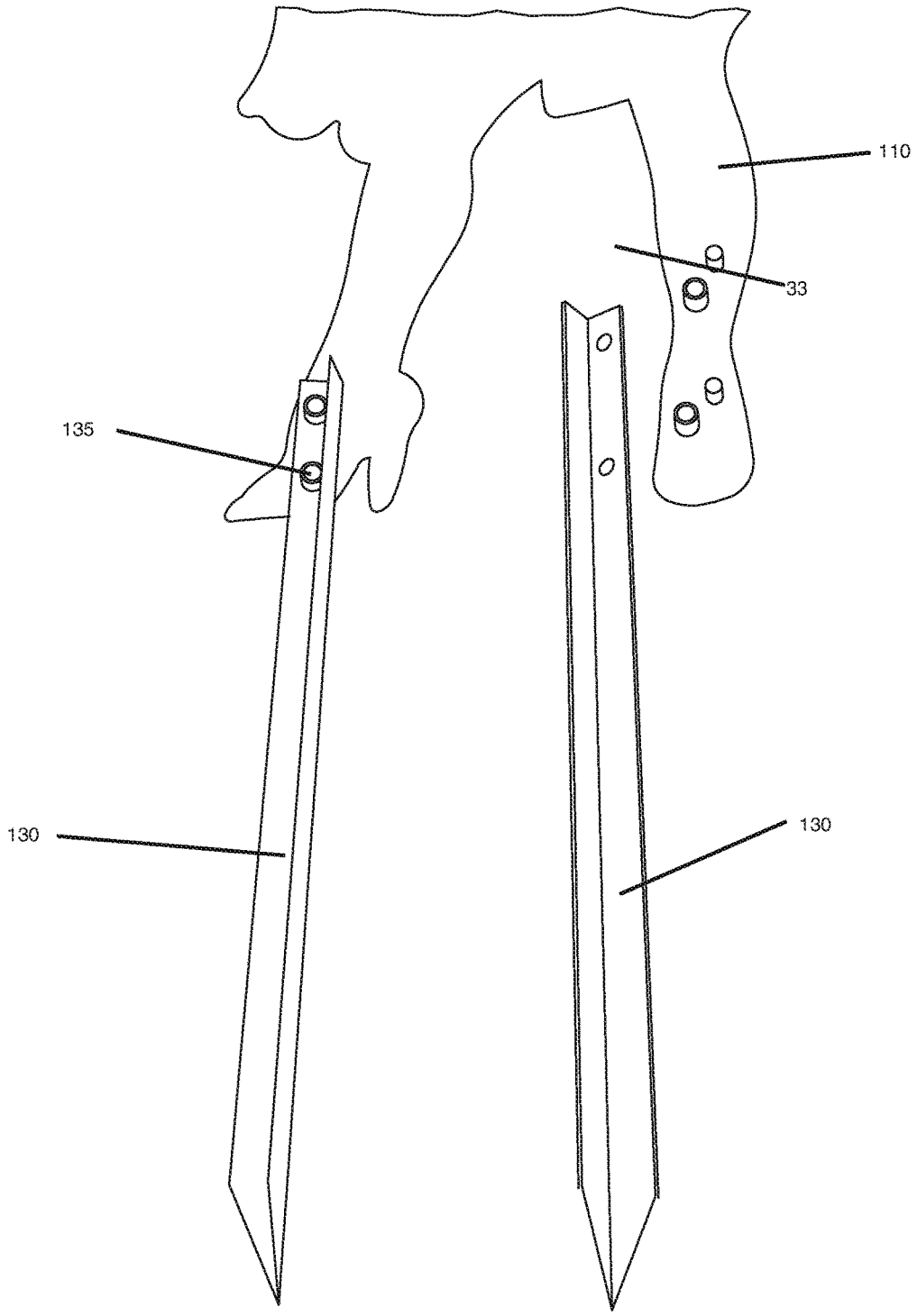
FIG. 4 shows a fragment view of the mailbox support system's bottom attachment to stake type brackets of the disclosed technology.

FIG. 4 shows the stake type brackets 130 being attached to the bottom side of the silhouette shape 110. One attachment method is with bolts 135. FIG. 3 illustrates the stakes type brackets 130 after they are placed in the ground 140.

FIG. 5 through 8 have the silhouette shape 110 supporting the mailbox 160 from underneath, which is the preferred placement of the mailbox 160. FIGS. 5, 6, 7 and 8 illustrate four of the many possible silhouette shapes 110 that are available to be used.

One method of making the silhouette shape 110 is to derive it from a tracing of a picture or a CNC transferring onto a sheet of material, then cutting out that same shape. Alternatively, another method of creating the silhouette shape 110 is by using a mold or casting of the shape. Thus, the silhouette shape 110 is unlimited in shapes that are available for use. The material used can be any material with sufficient strength to support a mailbox and provide long-term durability during exposure and use. For example, wood, plastic, composite plastics, carbon fiber or metal provide sufficient strength and durability. If the material used was metal, it is preferably coated with a plastic resin powder, which makes it very durable.

Once a shape is transferred onto the material of choice, the silhouette 110 is cut out using any well-known means of cutting the material of choice. These cutting methods include but are not limited to: saw cutting; flame cutting; plasma cutting; laser cutting; water jet cutting; or die cutting. Attachment of the stake type brackets 130 to the bottom side of a silhouette 110 is accomplished by any well-known means of attachment.

The entire mailbox support system comprises three to four parts. First, there is the silhouette shape 110 of choice. Second, there is a top bracket 120 formed of sheet material and attached to the uppermost point of the mailbox. This bracket 120 is attached by any well-known means, but when metal is used, it can be welded to the silhouette shape 110. The bracket 120 is the structure to which a mailbox 160 is affixed.

One or any plurality of stake type brackets 130 are used to place the silhouette. Stake type brackets 130, are usually only one or two stakes, and are preferably angle iron stakes that are driven into the ground 140 and then attached to the bottom side of the silhouette 110. The attachment of the stake type brackets 130 to the silhouette 110 is preferably by bolt 135 when the material is metal.

The mailbox support system 100 is designed to bend or break away if struck by a vehicle. This ability to bend or break away would prevent damage to the vehicle and its occupants. The ability to bend or break away is accomplished firstly because the material of this thickness has low yield strength and will easily break or bend when subjected to significant force. Materials such as mild steel, composite plastics, wood, or carbon fiber would all behave in this manner due to the low yield strength at the thickness of the disclosed technology.

Secondly, by securing the stake type brackets 130 to the silhouette 110 using low shear strength bolts 135 such as aluminum, the silhouette 110 will readily break away from the stake type brackets 130 since the low shear strength bolts 135 will not offer resistance to the force of impact.

Referring now to FIG. 5, FIG. 5 is a perspective view of one mailbox support silhouette shape with a mailbox attached of the disclosed technology. The mailbox 160 has a bottom side 166 attached to the top side of the silhouette, specifically, a head of the silhouette 110. The head can have a rounded or flat top side which connects to the mailbox (meaning that the rounded or flat top side is abutted against a mailbox to which it is connected, or connected by way of a bracket 120 or another fastening mechanism which interposes between the top side and the mailbox). The mailbox has a front side door 162 with hinged opening as is known in the art of mailboxes, a rear side 164 opposite the front side, and an interior space for receiving mail. As shown, the silhouette is centered with reference to each (left and right) side of the mailbox in some embodiments, and is far thinner than the mailbox.

FIG. 6 is a perspective view of another mailbox support silhouette shape with a mailbox attached of the disclosed technology. The leg regions 56/58 join together at a particular horizontal plane, which is the upper most extent of the leg regions and lower most extent of the body region. The arm region 54 is open to the mailbox, defining its separation from the body where its width remains substantially or mostly the same until joining with the body. A bend in the arm region of about 70 to 110 degrees, or 90 degrees, signifies an "elbow" which may be the furthest back portion of an arm region. A front arm extends further front than the body, and a back arm extends further back than the body. Between an arm, or each arm, and the bottom side of the mailbox is an open space.

Figure 8:
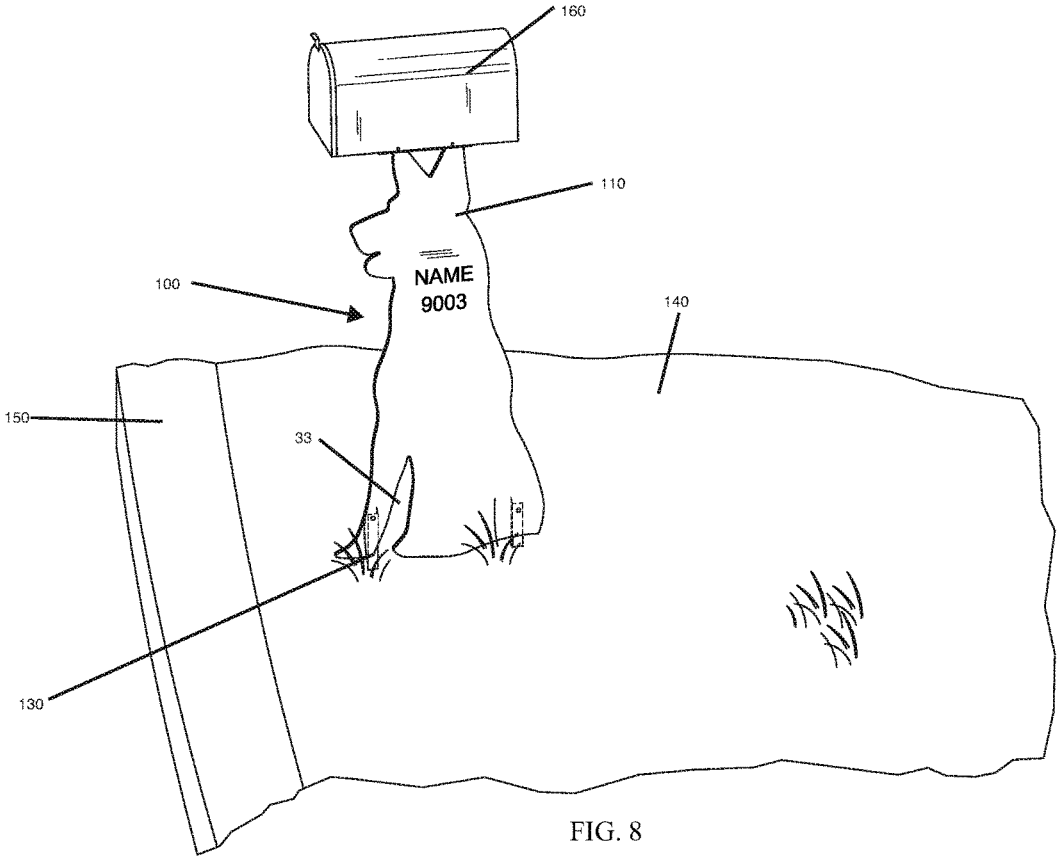
FIG. 8 is a perspective view of a fourth mailbox support silhouette shape with a mailbox attached of the disclosed technology.

FIG. 8 is a perspective view of a fourth mailbox support silhouette shape with a mailbox attached of the disclosed technology. Here, the body has a wide "leg" and a narrow "leg" with a portal 33 there-between each leg. The top of the silhouette is spaced apart creating a further portal between the two attachment points of the silhouette to the mailbox 160.

Figure 9:
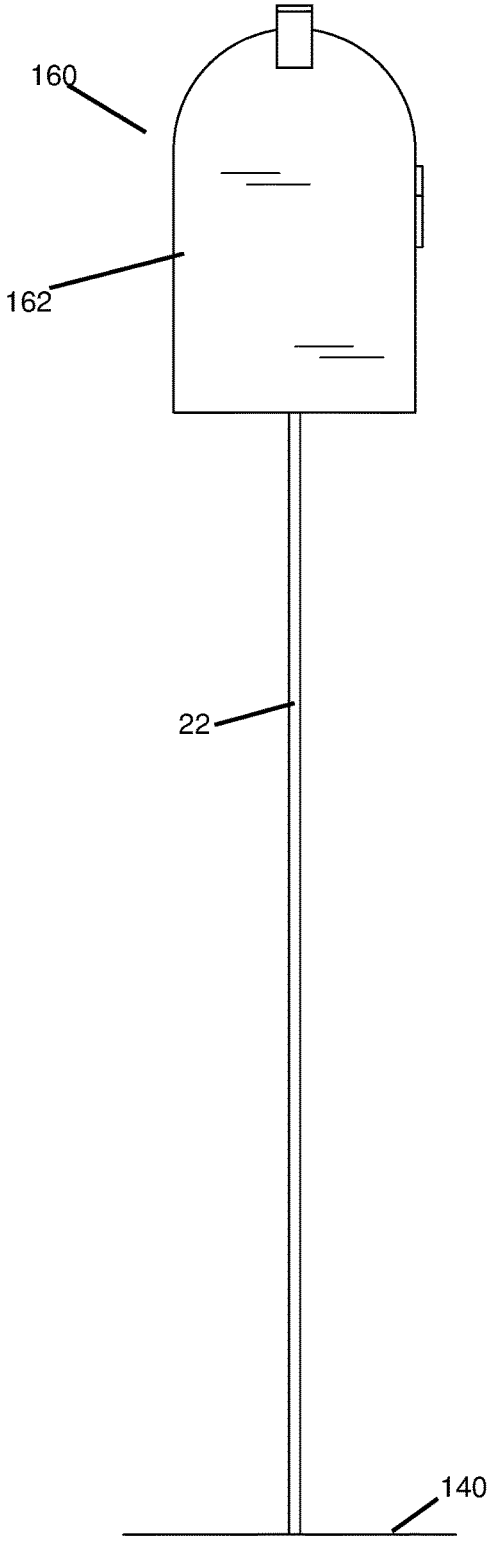
FIG. 9 shows a front view of a mailbox support with mailbox.

FIG. 9 shows a front view of a mailbox support with mailbox. From the front, looking straight at the front end 162 of the mailbox 120 one sees the thickness 22 of the silhouette/mailbox support 100 without seeing much (less than 5%) or any (when looking directly at the support) of the depth of the mailbox support. From this view, the mailbox support 100 can look like a pole of a mailbox, and thus, from the perspective of a mail carrier delivering mail, the press of delivering mail is identical to that of delivery to prior art mailboxes.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. A mailbox support system comprising:

a silhouette of a figure having a thickness less than or equal to 1/224th of it's height and a first leg region and a second leg region;

each first leg region and said second leg region being attached to a stake, said stake configured to extend below ground;

a mailbox having a lower side centered over said silhouette and at least partially situated over a space between said first leg region and said second leg region wherein a front side of said mailbox is defined by a side with a door opening into said mailbox and said first leg region extends further in a frontal direction than said mailbox.

2. The mailbox support system of claim 1, wherein said second leg region extends further back than a back side of said mailbox, said back side being opposite said front side.

3. The mailbox support system of claim 1, further comprising a portal in a top side of said silhouette such that two spaced-apart regions of said silhouette are connected to said mailbox.

4. The mailbox support system of claim 1, further comprising a rounded top side of said silhouette connected to said mailbox.

5. The mailbox support system of claim 1, further comprising a center of gravity between said first leg region and said second leg region in said space created between said first leg region and said second leg region.

6. A mailbox comprising:

a flat bottom side of said mailbox extending between a front side and back side thereof, said front side comprising a hinged door;

a silhouette less than ⅕th of a width of said mailbox residing there-below;

a connection mechanism connecting said mailbox into a top side of said silhouette;

at least one of a front side of said silhouette or a back side of said silhouette extending further to a respective front or back side than said mailbox;

at least two stakes attached to a bottom side of said silhouette, attaching said silhouette to or through the ground.

7. The mailbox of claim 6, further comprising a spaced apart region between said at least two stakes where said silhouette splits into two parts, each part of said two parts separately attached to or through the ground.

8. The mailbox of claim 7, having a center of gravity in said spaced apart region.

9. The mailbox of claim 6, wherein said silhouette has a width less than 1/224th of it's maximum height.

10. The mailbox of claim 6, further comprising a body region directly under a head region, said head region forming a top most region of said silhouette which is terminated at a neck region which is less distant from front to back than said head region.

11. The mailbox of claim 10, further comprising two arm regions forming a unitary structure with said body region, being defined by having a narrow contiguous portion with said body region and open space between each of said two arm regions and said mailbox.

12. The mailbox of claim 11, wherein at least one arm region of said two arm regions extends further back than said mailbox while said body region is entirely under said mailbox.

13. The mailbox of claim 12, wherein a furthest back portion of said mailbox corresponds to an elbow on said silhouette.

* * * * *